US008779736B2

(12) United States Patent
Gao et al.

(10) Patent No.: US 8,779,736 B2
(45) Date of Patent: Jul. 15, 2014

(54) ADAPTIVE MILLER COMPENSATED VOLTAGE REGULATOR

(75) Inventors: Sarah Gao, Shanghai (CN); David Peng, Shanghai (CN)

(73) Assignee: STMicroelectronics R&D (Shanghai) Co., Ltd., Shanghai (CN)

( * ) Notice: Subject to any disclaimer, the term of this patent is extended or adjusted under 35 U.S.C. 154(b) by 433 days.

(21) Appl. No.: 12/823,101

(22) Filed: Jun. 24, 2010

(65) Prior Publication Data

US 2011/0018510 A1 Jan. 27, 2011

(30) Foreign Application Priority Data

Jul. 21, 2009 (CN) ..... 2009 1 0151456

(51) Int. Cl.
*G05F 1/575* (2006.01)
*G06G 7/26* (2006.01)
*H01F 27/42* (2006.01)

(52) U.S. Cl.
USPC ..... 323/280; 323/315; 323/353; 323/364

(58) Field of Classification Search
CPC ..... G05F 1/575
USPC ..... 323/280, 274, 272, 282, 284, 315, 353, 323/356, 352, 209, 303, 298; 363/22, 24, 363/31, 131
See application file for complete search history.

(56) References Cited

U.S. PATENT DOCUMENTS 5,479,088 A * 12/1995 Hayakawa et al. ..... 323/282
5,539,603 A 7/1996 Bingham
5,808,484 A * 9/1998 Phillips et al. ..... 327/18
5,861,736 A 1/1999 Corsi et al.
5,929,616 A * 7/1999 Perraud et al. ..... 323/274
6,020,727 A 2/2000 Bernard et al.
6,300,749 B1 10/2001 Castelli et al.
6,674,274 B2 * 1/2004 Hobrecht et al. ..... 323/285
6,677,735 B2 1/2004 Xi
6,703,815 B2 * 3/2004 Biagi ..... 323/280
7,391,192 B2 * 6/2008 Ostrom et al. ..... 323/274
2005/0077952 A1 * 4/2005 Okada ..... 327/539
2007/0210726 A1 * 9/2007 Illegems ..... 315/291
2007/0241730 A1 * 10/2007 Dow et al. ..... 323/280
2009/0001953 A1 * 1/2009 Huang ..... 323/281
2009/0002056 A1 * 1/2009 Doyle et al. ..... 327/512
2010/0225332 A1 * 9/2010 Niwa et al. ..... 324/652

FOREIGN PATENT DOCUMENTS

EP 0862102 A1 9/1998

OTHER PUBLICATIONS

The State Intellectual Property Office of the People's Republic of China; Notification of the Second Office Action re. Application No. 200910151456.7; Applicant: STMicroelectronics R&D (Shanghai) Co., Ltd.; Date of Notification: Dec. 28, 2012, pp. 1-2.
The State Intellectual Property Office of the People's Republic of China; Notification of the First Office Action re. Application No. 200910151456.7; Applicant: STMicroelectronics R&D (Shanghai) Co., Ltd.; Date of Notification: Feb. 1, 2012,; pp. 1-14.

* cited by examiner

*Primary Examiner* — Gary L Laxton
*Assistant Examiner* — Trinh Dang
(74) *Attorney, Agent, or Firm* — Hogan Lovells US LLP

(57) ABSTRACT

A linear voltage regulator includes a Miller frequency compensation having a movable zero, which tracks the frequency of the load pole as the load condition changes. The compensated voltage regulator maintains stability under variable load conditions. Because of the Miller effect, DC open-loop gain and bandwidth are not sacrificed for stability. The compensated voltage regulator can therefore maintain high power supply rejection ratio (PSRR).

10 Claims, 4 Drawing Sheets

ADAPTIVE MILLER COMPENSATED VOLTAGE REGULATOR

RELATED APPLICATION

The present application claims priority of Chinese Application No. 200910151456.7 filed Jul. 21, 2009, which is incorporated herein in its entirety by this reference.

FIELD OF THE INVENTION

The present invention relates generally to voltage regulators, and, more particularly, to a circuit and method for compensating a linear voltage regulator using Miller compensation.

BACKGROUND OF THE INVENTION

Voltage regulators are commonly used in power management systems of PC motherboards, laptop computers, mobile phones and many other products. In these systems, the regulator design is required to operate in conjunction with a widely varying load impedance, while maintaining a high PSRR ("Power Supply Rejection Ratio"). For example, in a mobile phone, a voltage regulator usually provides power supply for several devices. Those devices can be enabled independently. Thus, the load of the regulator varies. The voltage regulator should provide stable voltage supply for these devices under different load conditions. In addition, to provide a clean voltage supply to the devices, the voltage regulator also needs to suppress voltage disturbances from its unregulated supply (batteries, switching regulators, and other unregulated voltage sources). This application requires a high PSRR voltage regulator circuit. What is desired, therefore, is a voltage regulator design with high PSRR and high stability under variable load conditions. The present invention is targeted to solve these problems.

A conventional voltage regulator 100 is illustrated in FIG. 1. The conventional linear regulator 100 includes an amplifier 102, a driver transistor PSW, and a resistor divider R1 and R2 coupled between the drain of PSW and ground. The center tap of the resistor divider is fed back to the negative input of the amplifier 102. The positive input of the amplifier 102 receives a reference voltage as is known in the art. The VDD power supply voltage in FIG. 1 is the unregulated input voltage and the VOUT terminal at the drain of transistor PSW is the regulated output voltage. An exemplary load is shown in FIG. 1, including a load capacitor CL and the Equivalent Series Resistor (R_ESR), and the desired load 104. The capacitor Cpar is the parasitic capacitance at the gate of transistor PSW.

The conventional voltage regulator 100 shown in FIG. 1 has a problem in that it is prone to instability. The load impedance 104 of the regulator 100 can introduce a pole into the transfer function of the circuitry. This load pole varies greatly when the load condition changes. If the load impedance 104 varies over too great a range, an unstable feedback loop may be incurred.

To solve the instability issue, a voltage regulator as disclosed in U.S. Pat. No. 6,300,749 provides within the circuit response a zero capable of moving according to the load variations in load 206. As shown in FIG. 2, compensated voltage regulator 200 introduces a delay phase network (capacitor Cc and resistor Rc) between an operational transconductance amplifier 202 and a buffer amplifier 204, which introduces a zero and a pole to the circuitry. The zero of the regulator is movable to compensate the effect of the variable second pole in the loop gain.

The voltage regulator 200 shown in FIG. 2 provides a compensation network with a moving zero to compensate the variable load pole. However, because the pass transistor PSW usually has a relatively large size, it will introduce a relatively low frequency pole at the gate of the pass transistor. Thus, the regulator 200 needs to either lower the frequency of the dominant pole, or decrease the open-loop dc gain. This approach is limited for those applications needing high PSRR and high bandwidth systems.

SUMMARY OF THE INVENTION

According to an embodiment of the present invention a compensated linear voltage regulator uses adaptive Miller compensation to maintain stability under variable load conditions. The voltage regulator of the present invention can maintain stability under variable load conditions through a movable zero. The zero frequency changes as the load condition of the regulator varies, so that it can compensate a non-dominant pole, which varies according to the load conditions. At the same time, the circuit of the present invention has no need to sacrifice loop gain or bandwidth for stability. Thus, the circuit of the present invention can maintain high PSRR either at low frequencies or at high frequencies. The regulator of the present invention is suitable for those applications requiring high PSRR and robust stability under variable load conditions.

BRIEF DESCRIPTION OF THE DRAWINGS

The aforementioned and other features and objects of the present invention and the manner of attaining them will become more apparent and the invention itself will be best understood by reference to the following description of a preferred embodiment taken in conjunction with the accompanying drawings, wherein.

DETAILED DESCRIPTION

Figure 3:
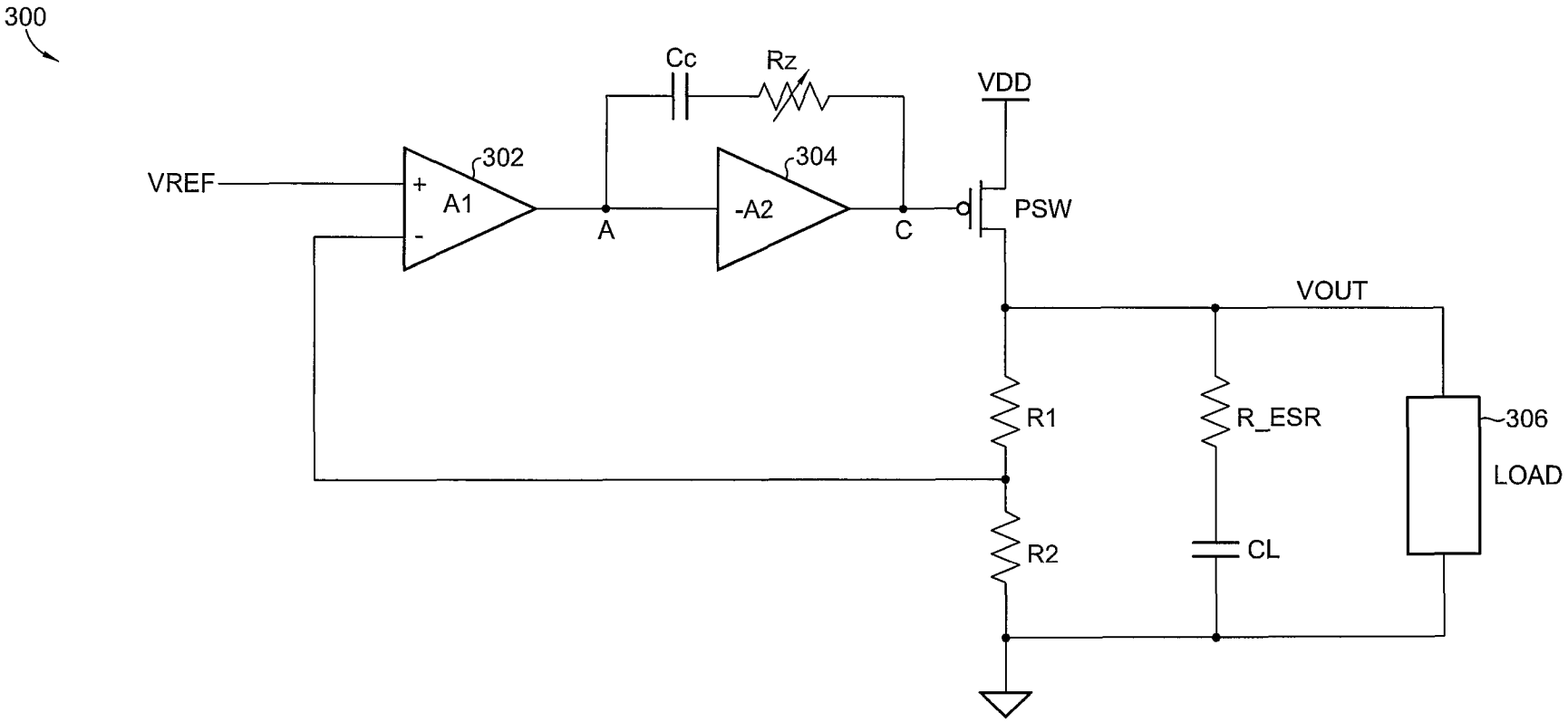
FIG. 3 is a schematic diagram of a Miller compensated linear voltage regulator according to an embodiment of the present invention.

Referring now to FIG. 3, an adaptive Miller compensated voltage regulator 300 includes a voltage regulator and adaptive Miller compensation having a movable zero, which tracks the frequency of a load pole as the load condition changes such that stability is maintained under variable load conditions.

Figure 1:
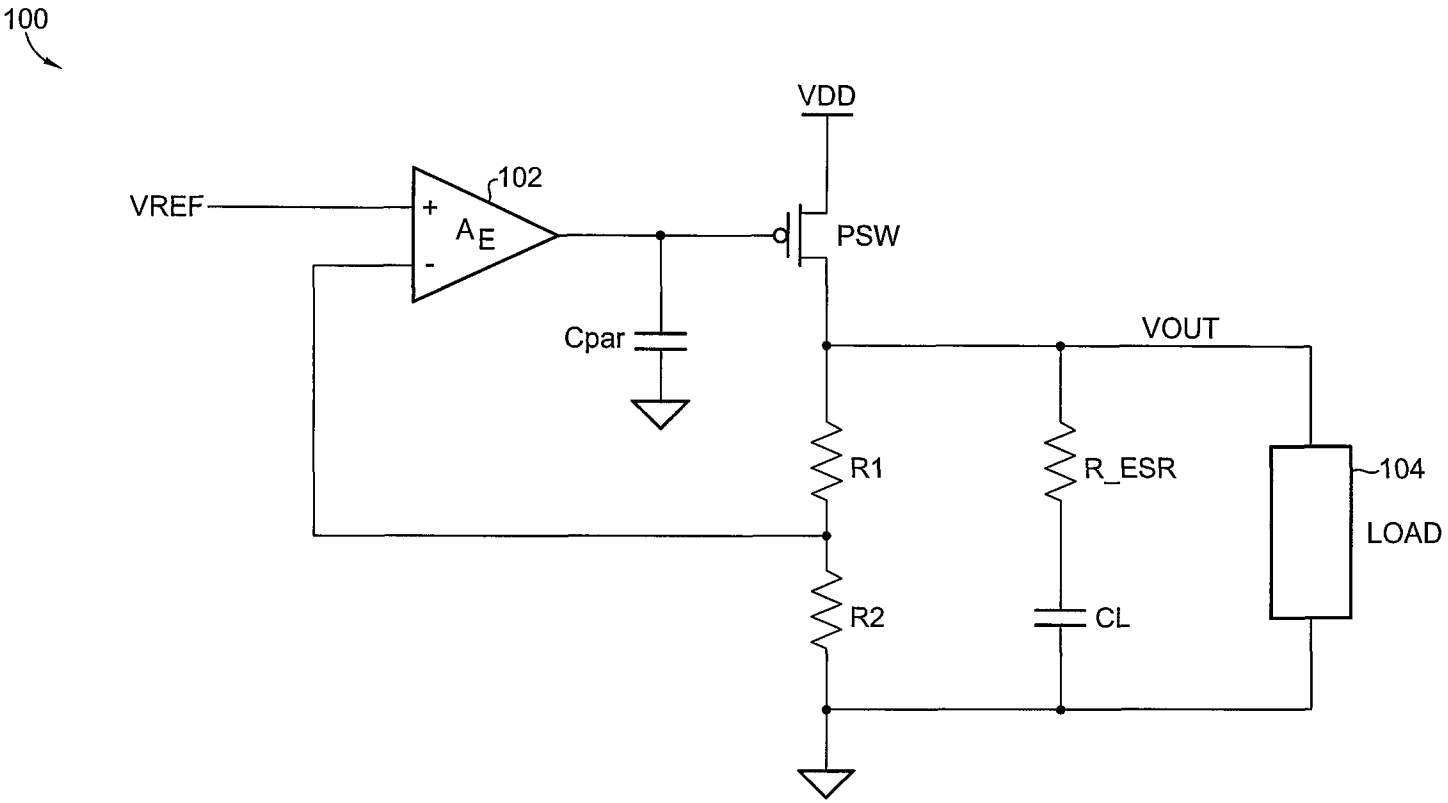
Fig. 1 Prior Art
FIGS. 1 and 2 are schematic diagrams of prior art compensated linear voltage regulators.
Figure 2:
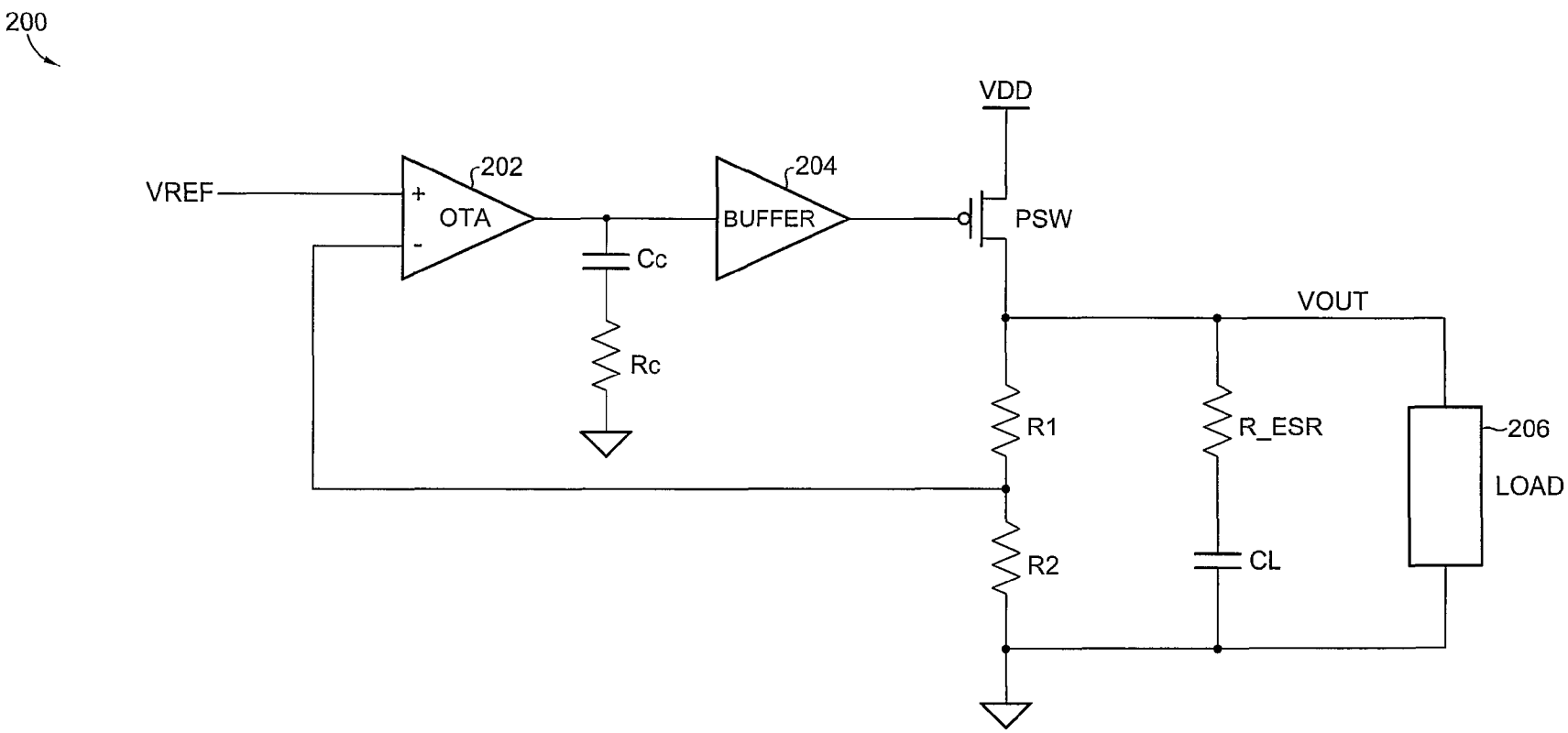
Fig. 2 Prior Art

The adaptive Miller compensated voltage regulator includes a first amplifier 302 having a first input for receiving a reference voltage VREF, a second input, and an output, a second amplifier 304 having an input coupled to the output of the first amplifier 302, and an output, a variable impedance compensation network (capacitor Cc and serially coupled resistor Rz) having a first terminal (node A) coupled to the input of the second amplifier 304 and a second terminal (node C) coupled to the output of the second amplifier 304, a pass transistor PSW having a control terminal coupled to the output of the second amplifier 304, and a current path, and a feedback network (serially coupled resistors R1 and R2) in the current path of the pass transistor PSW, and a center tap thereof coupled to the second input of the first amplifier. The first amplifier 302 is an operational transconductance amplifier, and the second amplifier is a voltage amplifier with negative gain. Typically, the gain is set to between about several tens of decibels. The variable impedance compensation network includes a capacitor with a typical value between 10 pF and 40 pF. The variable impedance compensation network also includes a variable resistance with a typical range of values between 300 Kohm and 5 Megohm. While these are typical values and ranges of values, the exact number for a specific design could be different based upon a particular application. In a practical implementation, the variable resistor Rz can be an active device, such as a diode, a bipolar transistor, or a MOS transistor. A specific circuit embodiment of the compensated regulator according to the present invention will be shown and described below with respect to FIG. 4. In FIG. 3, the pass transistor PSW is shown to be a P-channel MOS transistor. As is known to those skilled in the art, the pass transistor could also be made to be an N-channel transistor, in which case the feedback network coupled be referenced to VDD. The desired load 306 and parasitic load are substantially the same as shown in FIGS. 1 and 2.

As previously mentioned, the present invention relates to a circuit and method for maintaining stability within a linear voltage regulator circuit under variable load conditions, while the regulator circuit maintains high PSRR. Referring again to regulator 300 of FIG. 3, there are mainly three poles in this circuit. The pole at node A is the dominant pole (P1). The pole at VOUT is variable with the load (P2). The third pole of regulator 300 is at node C (P3). Miller compensation according to the present invention splits the poles so that P1 moves to a lower frequency, and P3 moves to higher frequency. If the variable pole P2 can be compensated, the loop can be stable simply by using the Miller capacitor. Here, the variable resistance Rz and the Miller capacitor Cc introduce a zero (Z1). Since Rz tracks the load condition, this zero is movable with load changes, which is used to compensate the variable pole.

Figure 4:
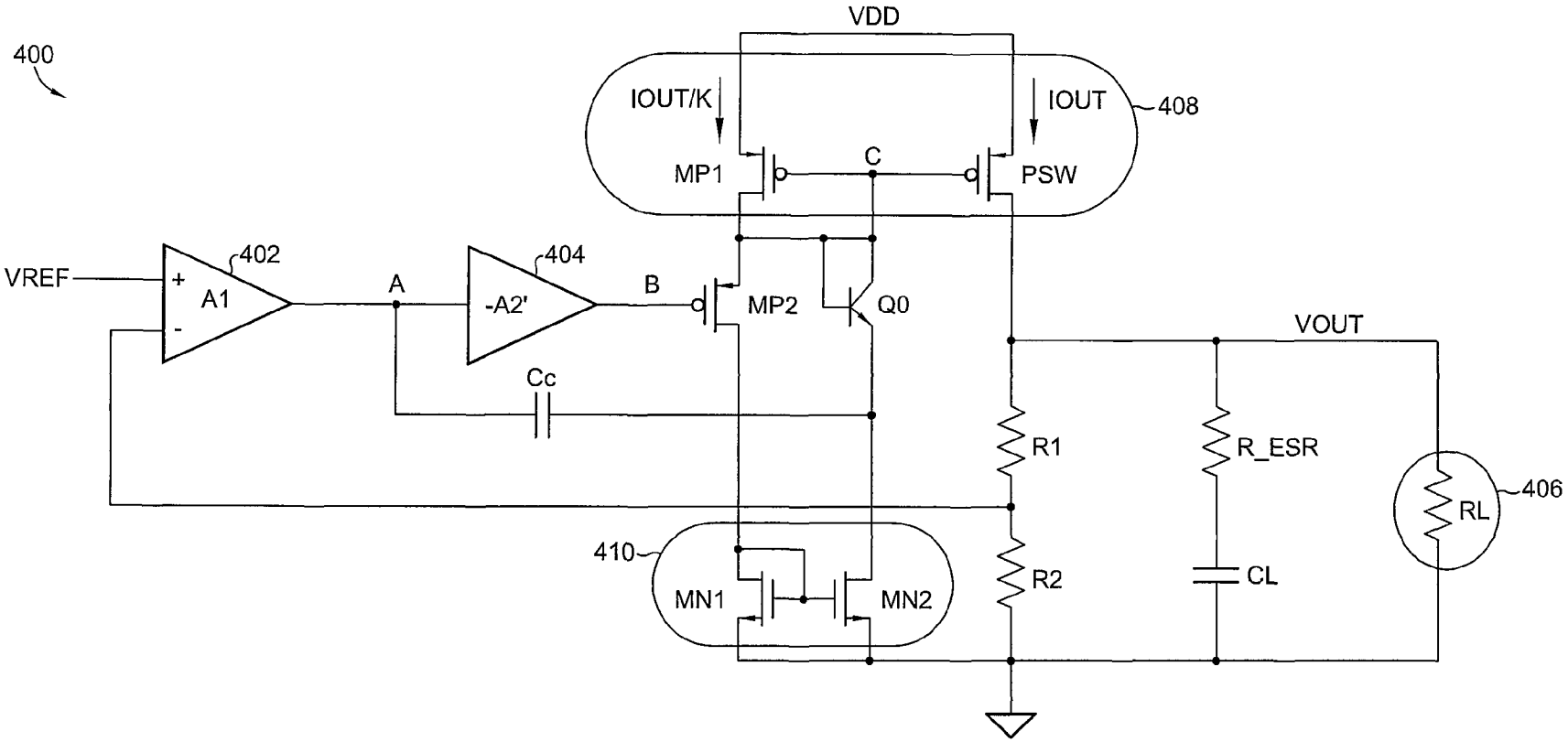
FIG. 4 is a schematic diagram of a practical transistor-level circuit implementation of the voltage regulator shown in FIG. 3 according to the present invention.

FIG. 4 is an example of the implementation of FIG. 3. A compensated voltage regulator 400 according to the present invention includes a first amplifier 402 having a first input for receiving a reference voltage VREF, a second input, and an output, a second amplifier 404 having an input coupled to the output of the first amplifier 402, and an output, a pass transistor MP2 having a control terminal coupled to the output of the second amplifier 404, and a current path, a first current mirror 408 having an input coupled to the current path of the pass transistor MP2, and an output, a second current mirror 410 having an input coupled to the current path of the pass transistor MP2, and an output; a variable impedance compensation network (diode-connected transistor Q0 and capacitor Cc) having a first terminal coupled to the input of the first current mirror 408, a second terminal coupled to the output of the second current mirror 410, and a third terminal coupled to the input of the second amplifier 404, and a feedback network (R1, R2) in the current path of the output of the first current mirror, and coupled to the second input of the first amplifier 402. The first amplifier 402 is an operational transconductance amplifier, and the second amplifier is a voltage amplifier with negative gain. The variable impedance compensation network includes a capacitor Cc coupled to a variable resistance provided by an active device, diode-connected transistor Q0 as shown in FIG. 4. A diode, bipolar transistor, or MOS transistor could also be used to provide the variable resistance. In FIG. 4, pass transistor MP2 is shown as a P-channel transistor, the first current mirror 408 is a P-channel current mirror, and the second current mirror is an N-channel current mirror. The entire circuit of FIG. 4 can be "flipped" as is known by those in the art by substituting P-channel for N-channel devices, and substituting VDD for ground, and vice versa.

In FIG. 4, diode-connected bipolar transistor Q0 acts as a variable resistance element. Transistors MN1 and MN2 form a current sensing network 410. The three poles of circuit 400 (P1, P2 and P3) and zero (Z1) are given below:

$$P1 \approx \frac{1}{r_{01} \cdot C_c \cdot A2'} \quad \text{(EQ. 1)}$$

$$P2 \approx \frac{1}{R_L \cdot C_L} \approx \frac{I_{OUT}}{V_{OUT} \cdot C_L} \quad \text{(EQ. 2)}$$

$$P3 \approx \frac{g_{m3}}{C_3} \quad \text{(EQ. 3)}$$

$$Z1 \approx \frac{1}{R_Z \cdot C_c} \approx \frac{g_{mQ0}}{C_c} = \frac{I_{Q0}}{V_T \cdot C_c} = \frac{I_{OUT}}{K \cdot M \cdot V_T \cdot C_c} \quad \text{(EQ. 4)}$$

In the above equations, $r_{01}$ is the output resistance of amplifier 402 A1, $g_{m3}$ is the equivalent transconductance at node C, C3 is the equivalent capacitance at node C, VT is thermal voltage, K is the size ratio of PSW and MP1, and M is the size ratio of MN1 and MN2.

From EQ. 2 and EQ. 4, it can be found that P2 is proportional to Z1. Z1 is tracking P2. Therefore, selecting for proper K and M, the variable pole P2 can be compensated with Z1.

Since the variable pole can be compensated, it is easy to make the circuit stabilized simply by Miller compensation. The Miller compensation can split the two poles (P1 and P3), so it has no need to decrease the open-loop gain or bandwidth for stability. Typically, in voltage regulator designs, the PSRR is mainly determined by the open-loop gain of the circuit, pass transistor PSW, and the position of internal poles. Thus the PSRR can be maintained high for both low frequency and high frequency because no sacrifice need be made on the open-loop gain and bandwidth.

The compensated voltage regulator of the present invention can be adopted in most voltage regulator designs that require high PSRR and robust stability under variable load conditions.

While there have been described above the principles of the present invention in conjunction with specific implementations of a ferroelectric memory in accordance with the present invention, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features which are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The applicants hereby reserve the right to formulate new claims to such features and/or combinations of such features during the prosecution of the present application or of any further application derived therefrom.

We claim:

1. A compensated voltage regulator comprising:

a first amplifier having a first input for receiving a reference voltage, a second input, and an output;

a second amplifier having an input coupled to the output of the first amplifier, and an output;

a pass transistor having a control terminal coupled to the output of the second amplifier, and a current path;

a first current mirror having an input coupled to the current path of the pass transistor, and an output;

a second current mirror having an input coupled to the current path of the pass transistor, and an output;

a variable impedance compensation network having a first terminal coupled to the input of the first current mirror, a second terminal coupled to the output of the second current mirror, and a third terminal coupled to the input of the second amplifier; and a feedback network in the current path of the output of the first current mirror, and coupled to the second input of the first amplifier, wherein the variable impedance comprises a capacitor and a variable resistor in series, and wherein the variable resistor comprises a diode configured to receive a replica current proportional to a load current, and wherein the voltage regulator comprises a linear voltage regulator, and wherein the first current mirror has a source terminal coupled to VDD, and the second current mirror has a source terminal coupled to ground.

2. The compensated voltage regulator of claim 1 wherein the first amplifier comprises an operational transconductance amplifier.

3. The compensated voltage regulator of claim 1 wherein the second amplifier comprises an amplifier with negative gain.

4. The compensated voltage regulator of claim 1 wherein the diode comprises a diode-connected transistor.

5. The compensated voltage regulator of claim 4 wherein the diode-connected transistor comprises a bipolar transistor.

6. The compensated voltage regulator of claim 4 wherein the diode-connected transistor comprises a MOS transistor.

7. The compensated voltage regulator of claim 1 wherein the pass transistor comprises a P-channel MOS transistor.

8. The compensated voltage regulator of claim 1 wherein the feedback network comprises first and second resistors, a node between the first and second resistors being coupled to the second input of the first amplifier.

9. The compensated voltage regulator of claim 1 wherein the first current mirror comprises a P-channel current mirror.

10. The compensated voltage regulator of claim 1 wherein the second current mirror comprises an N-channel current mirror.

* * * * *